United States Patent [19]

Balordi

[11] 4,443,679

[45] Apr. 17, 1984

[54] INDUCTION FURNACE FOR HEAT SHRINKING THERMOPLASTIC SHEET ONTO MANDRELS IN A FORMING PROCESS

[75] Inventor: Romano Balordi, Millers, Md.

[73] Assignee: Maryland Cup Corporation, Owings Mills, Md.

[21] Appl. No.: 276,830

[22] Filed: Jun. 24, 1981

[51] Int. Cl.[3] ..... H05B 5/04

[52] U.S. Cl. ..... 219/10.49 R; 219/10.57; 219/10.79; 219/10.69; 219/10.47; 264/342 R; 425/174.4; 425/174.8 R

[58] Field of Search ..... 219/10.41, 10.43, 10.49, 219/10.53, 10.75, 10.57, 10.79, 10.67; 264/DIG. 71, 342 R, 80, 289.6, 25, 230, 26, 27; 425/174.8 R

[56] References Cited

U.S. PATENT DOCUMENTS

| | | | |
|---|---|---|---|
| 1,975,436 | 10/1934 | Sorrel et al. | 219/10.41 |
| 1,997,741 | 4/1935 | Northrup | 219/10.49 |
| 2,226,446 | 12/1940 | Smith et al. | 219/10.41 |
| 2,583,330 | 1/1952 | Eckert | 264/26 |
| 4,017,229 | 4/1977 | Sudo | 425/71 |
| 4,269,640 | 5/1981 | Ruiz et al. | 156/84 |
| 4,298,331 | 11/1981 | Mueller | 425/393 |

*Primary Examiner*—B. A. Reynolds
*Assistant Examiner*—M. M. Lateef
*Attorney, Agent, or Firm*—Birch, Stewart, Kolasch & Birch

[57] ABSTRACT

An induction furnace utilizes a channel-shaped induction coil disposed along a mandrel movement line within a cup-making machine to produce eddy currents within a conductive grid arranged intermediate between the induction coil and the mandrel movement line and also within the mandrels themselves. Cylindrical thermoplastic sheet blanks are mounted on the mandrels, and as a result of the heat generated by the eddy currents within the conductive grid and mandrel itself, shrink about the mandrel to produce a finished container conforming to the surfaces of the mandrel. The induction coil is driven by a high frequency alternating current power supply and may be controlled by the placement of a thermocouple within the furnace. By varying the permeability of the inductive grid and the forming mandrel, the mandrel temperature may be controlled separately from the temperature applied to the exterior surface of the cylindrical blanks of thermoplastic material by the conductive grid.

41 Claims, 3 Drawing Figures

INDUCTION FURNACE FOR HEAT SHRINKING THERMOPLASTIC SHEET ONTO MANDRELS IN A FORMING PROCESS

FIELD OF THE INVENTION

The present invention is an induction furnace for heat shrinking stretch-oriented thermoplastic sheet material onto mandrels in a forming process. More particularly, the present invention is an apparatus for producing the temperatures necessary to heat shrink the thermoplastic material about its associated mandrels.

BACKGROUND OF THE INVENTION

Various methods have been used to heat shrink thermoplastic material about mandrels to form finished products of predetermined shapes. Both resistance and radiant heaters have been used to produce the temperatures necessary to shrink the thermoplastic material. However, the present invention exhibits a number of advantages over other techniques for heat shrinking the thermoplastic material. These advantages will become apparent from an examination of the following objects of the present invention.

OBJECTS OF THE INVENTION

It is an object of the present invention to efficiently and controllably produce the temperatures necessary to heat shrink thermoplastic material onto mandrels in a forming process.

It is another object of the present invention to produce an apparatus for heat shrinking thermoplastic material onto mandrels which may be quickly warmed up, thus allowing a quicker return to full production capacity after shut down.

It is a further object of the present invention to eliminate the need for a separate preheating of the mandrels, thereby reducing the complexity and cost of a forming apparatus incorporating the present invention therein.

It is a further object of the present invention to allow close control of both the mandrel temperature and the external temperatures applied to the thermoplastic foam sheet material to allow close control of the shrinkage rate and cosmetics of the finished products.

Still another object of the present invention is to provide a new and novel container-making process and apparatus.

SUMMARY OF THE INVENTION

The objects of the present invention are accomplished through the use of induction heating techniques in order to heat the thermoplastic material and associated mandrels. An RF current is applied to a channel-shaped induction coil, producing a strong oscillating electromagnetic field. Mandrels are passed through the center of the channel-shaped induction coil. These mandrels are fitted with preforms such as cylindrical blanks formed of stretch-oriented thermoplastic material. The electromagnetic field produced by the channel-shaped induction coil produces eddy currents within the mandrel, thus heating the mandrel to a desired temperature. Further, a conductive grid formed of U-shaped iron or steel bars is arranged intermediate of the channel-shaped induction coil and the mandrel having thermoplastic material disposed thereon. The oscillating electromagnetic field also generates eddy currents within the U-shaped bars of the grid. The grid is thus heated by the eddy current and therefore radiates heat in order to produce the temperatures necessary to shrink the thermoplastic material onto associated mandrels. The temperature of the grid may be controlled by varying the power applied to the channel-shaped induction coil through the use of feedback techniques. The relationship between the temperature of the grid and the temperature of the mandrel may be controlled by varying the relative permeabilities of the grid and mandrel to achieve the desired temperatures.

BRIEF DESCRIPTION OF THE DRAWINGS

The objects of the present invention and the attendant advantages thereof will become more readily apparent by reference to the following drawings wherein.

DETAILED DESCRIPTION OF THE PREFERRED EMBODIMENT

Figure 1:
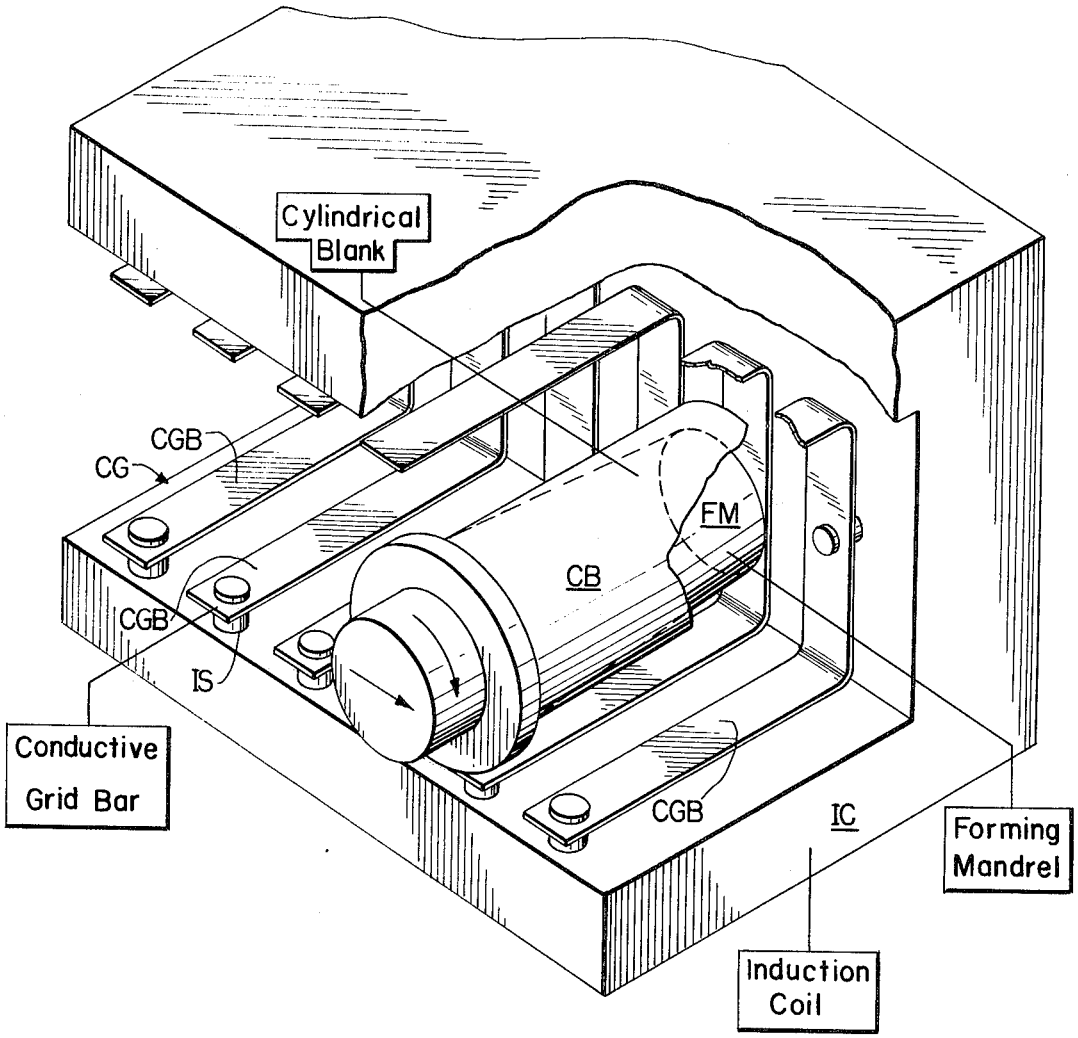
FIG. 1 is a perspective, partially broken away view of the apparatus of the present invention.
Figure 3:
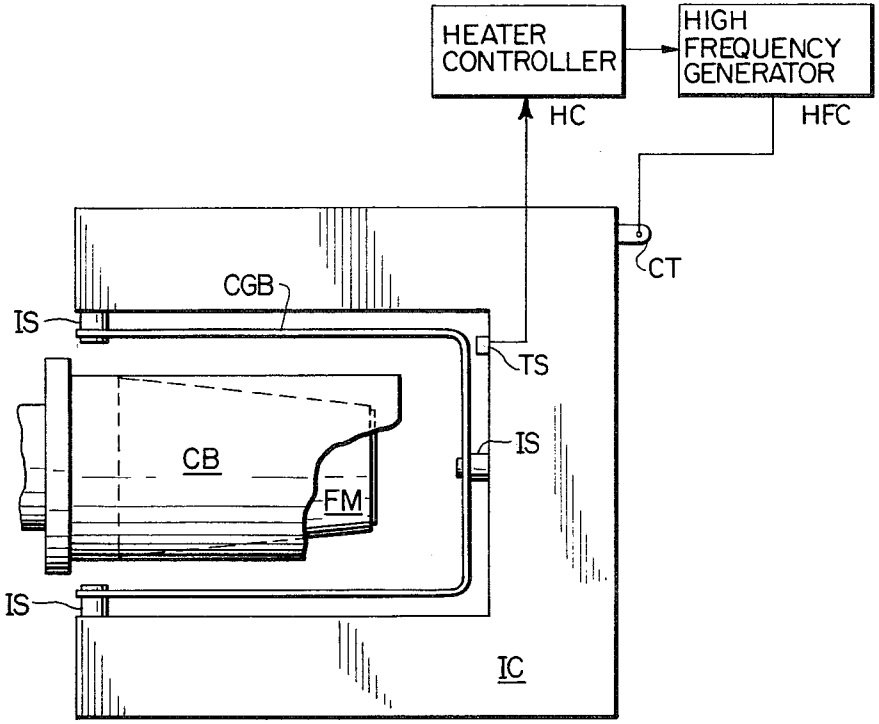
FIG. 3 is a side view of the apparatus of the present invention.
Figure 2:
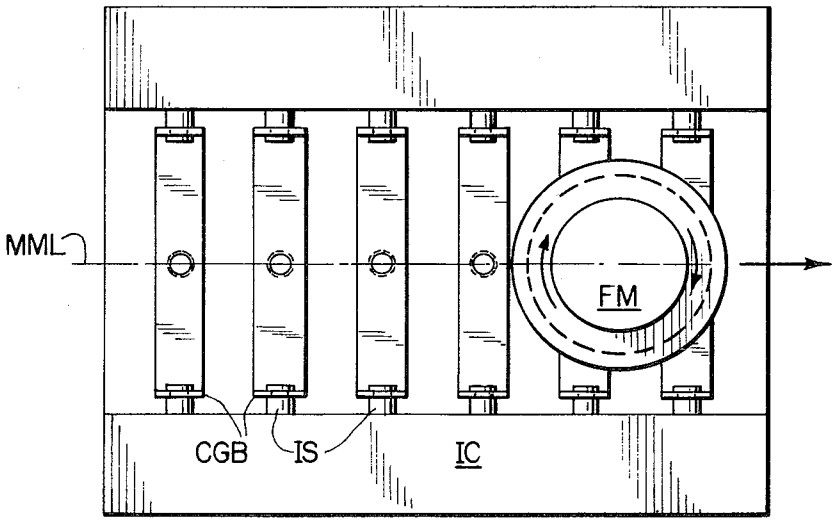
FIG. 2 is a front view of the apparatus of the present invention.

Referring collectively in detail the FIGS. 1, 2 and 3, there is illustrated the induction furnace of the present invention. A preferred embodiment of the induction furnace of the present invention is designed to be utilized in a cup-making machine having a plurality of forming mandrels FM uniformly spaced apart for movement along a mandrel movement line MML. The induction furnace of the present invention includes a channel-shaped induction coil IC which is mounted along the mandrel movement line MML so as to surround three sides of the forming mandrels FM as they pass therethrough. In the illustrated preferred embodiment, the channel-shaped induction coil IC surrounds the forming mandrels FM as they pass along a linear mandrel movement line MML. However, according to the teachings of the present invention, it should be understood that the channel-shaped induction coil IC may be shaped so as to surround the mandrels FM on three sides as they move along an arcuate mandrel movement line (not shown) or as they move in any desired path within the cup-making machine.

A conductive grid CG is disposed intermediate the channel-shaped induction coil IC and the forming mandrels FM as they pass along the mandrel movement line MML. This conductive grid CG may be arranged in any desired manner but should be disposed between the mandrels FM as they move along mandrel movement line MML and the channel-shaped induction coil IC. In the preferred embodiment, the conductive grid CG is formed of a plurality of conductive grid bars CGB which are generally U-shaped and which generally conform to the cross-sectional shape of the channel-shaped induction coil IC. The U-shaped conductive grid bars CGB are spaced away from the channel-shaped induction coil IC at a desired predetermined distance by a plurality of insulating spacers IS. The forming mandrels FM each have a cylindrical blank CB mounted thereon when the respective mandrels FM are passed through the induction furnace of the present invention. In the alternative, the forming mandrels FM may each have an arcuate blank (not shown) formed in a generally frusto-conical shape mounted on its respective mandrel.

In operation, as the forming mandrels FM and their associated cylindrical blanks CB of axially stretch-oriented thermoplastic material passed through the induction furnace of the present invention, a high frequency alternating current is applied to the channel-shaped induction coil IC. The channel-shaped induction coil IC thus produces an oscillating electromagnetic field which produces eddy currents both within the conductive grid CG and its individual conductive grid bars CGB and the forming mandrels FM themselves. These eddy currents generate heat within the conductive grid bars CGB and the forming mandrels FM. According to the teachings of the present invention, the relative permeabilities of the conductive grid bars CGB and the forming mandrels FM are adjusted so that the ratio of the temperature of the forming mandrel itself, and the temperature applied to the outer surface of the cylindrical blanks CB may be adjusted in order to produce a desired ratio. In the preferred embodiment, it is desirable to produce temperatures within the forming mandrel on the order of 175° F. while producing temperatures of between 700°-1000° F. within the conductive grid bars CGB. In the preferred embodiment, the conductive grid bars are made out of iron or steel with a relatively high permeability while the forming mandrel FM is made out of a material having a relatively low permeability, such as aluminum, stainless steel, or inconel.

The relative temperatures of the forming mandrel and conductive grid bars may also be varied by altering the relationship between the surface area of the conductive grid CG and the total surface area of the channel-shaped induction coil IC. By increasing the size of the grid bars, the amount of electromagnetic radiation applied to the forming mandrels FM as they pass through the induction furnace of the present invention is correspondingly reduced.

It can thus be seen that as the forming mandrels FM with their cylindrical blanks of foam thermoplastic sheet material CB pass through the induction furnace of the present invention, a relatively high heat is applied to the outer surfaces of the cylindrical blanks CB by radiant heat generated by the conductive grid bars CGB. Simultaneously, the mandrel FM is heated by the eddy currents formed therein to maintain the mandrel temperature at a desired level. Thus, the present invention eliminates the need for separately heating the mandrels to maintain their temperature, thus reducing the complexity and expense of the cup-making machine incorporating the present invention.

According to the teachings of the present invention, any shape may be utilized for the induction coil. However, it is important to provide conductive grid surfaces adjacent all areas in which heat is required. This is particularly true since the induction furnace of the present invention produces a relatively concentrated heating action. This relatively concentrated heating action makes it desirable to rotate the forming mandrels FM with their associated cylindrical blanks CB in order to more evenly heat the cylindrical blanks.

In order to allow more complete control of the permeability ratio between the conductive grid CG and the forming mandrels FM, according to the teachings of the present invention, it is possible to coat the mandrels FM with a layer having a desired permeability in order to more precisely control the ratio of temperatures produced by the conductive grid CG and the forming mandrels FM. For example, if a higher permeability is desired for the forming mandrels, the forming mandrels may be coated with a metal, for example steel, to thus raise their surface permeability and the corresponding induced temperature.

The induction coil IC of the present invention is designed to be driven by a solid state high frequency generator HFG connected to a pair of terminals CT of the induction coil IC. In the preferred embodiment, a model A-50 generator manufactured by Cycle-Dyne is used. This generator is capable of producing a power output of 5 KW with an output frequency of approximately 500 KHz from a 460 V single-phase power supply. According to the teachings of the present invention, the temperatures produced by the induction heater of the present invention may be controlled by varying the power applied to the induction coil IC by the high frequency generator HFG. To control the induction heater of the present invention, a thermocouple TS may be mounted in the induction furnace in close proximity to one of the conductive grid bars CGB. The signal monitored from this thermocoupled may be used as a feedback applied to a controller HC which controls the high frequency generator HFG to control the power applied to the induction coil IC to thereby render the temperature produced by the induction furnace of the present invention relatively constant.

Further, according to the present invention, the induction coil IC is potted in epoxy and may be cooled by the ambient air or, if necessary, may be water-cooled by the inclusion of copper cooling tubing in the induction coil's core.

It should be understood that the induction furnace described herein may be modified as would occur to one of ordinary skill in the art without departing from the spirit and scope of the present invention.

We claim:

1. Means for heat shrinking thermoplastic preforms to a desired shape comprising:

mandrel means of conductive material and said desired shape for receiving a said preform;

induction coil means adjacent said mandrel;

conductive grid means intermediate said mandrel and said induction coil; and means for energizing said induction coil means for simultaneously heating said mandrel and said grid means;

said grid means applying radiant heat to said preform.

2. The invention of claim 1 wherein said induction coil means is driven by an alternating current;

the current passing through said coil producing eddy currents in said mandrel means and said grid means to thereby produce heat.

3. The invention of claim 2 wherein the heat applied to said thermoplastic preform by said grid means is a function of the permeability and configuration of said grid means.

4. The invention of claim 3 wherein the heat applied to said thermoplastic preform by said mandrel means is a function of the permeability of said mandrel means.

5. Means for heat shrinking thermoplastic preforms to desired shapes comprising:

mandrel means of conductive material and said desired shapes for receiving said preforms and passing them along a mandrel movement line;

induction coil means disposed adjacent a length of said mandrel movement line;

conductive grid means intermediate said mandrel and said induction coil; and means for energizing said induction coil means for simultaneously heating said mandrel and said grid means to thereby apply heat to said preforms.

6. The invention of claim 5 wherein said induction coil means is driven by an alternating current;

the current passing through said induction coil means producing eddy currents in said mandrel means and said grid means to thereby produce heat.

7. The invention of claim 6 wherein said induction coil means has a generally channel-shaped configuration and substantially surrounds three sides of said mandrel means as it passes along said mandrel movement line.

8. The invention of claims 5 or 7 wherein said conductive grid means generally conforms to the shape of said induction coil means and is spaced therefrom by insulation means.

9. The invention of claim 8 wherein the conductive grid means is sized so as to receive a desired amount of electromagnetic radiation from said induction coil.

10. The invention of claim 9 wherein said conductive grid means includes a plurality of generally U-shaped grid bars spaced along said length of mandrel movement line.

11. The invention of claims 5 or 7 wherein said mandrel means rotate while passing along said mandrel movement line in the vicinity of said induction coil means.

12. The invention of claim 7 wherein said induction coil means extends along a generally linear mandrel movement line.

13. The invention of claim 7 wherein said induction coil extends along a generally arcuate mandrel movement line.

14. The invention of claim 8 wherein said conductive grid means has a permeability greater than that of said mandrel means.

15. The invention of claim 14 wherein the permeability of said conductive grid means is about 5 times the permeability of said mandrel means.

16. The invention of claim 15 wherein said conductive grid means is formed of a metal from the group consisting of iron and steel.

17. The invention of claim 15 wherein said mandrel means are formed of aluminum.

18. The invention of claim 17 wherein said mandrel means are coated with a coating having a desired permeability.

19. The invention of claim 17 wherein said mandrel means are heated to a temperature of approximately 175° F.

20. The invention of claim 16 wherein said conductive grid means is heated to a temperature of approximately 700° to 1000° F.

21. The invention of claims 5, 6 or 7 wherein the power applied to said induction coil means is varied to control the heat produced by said mandrel means and said grid means.

22. The invention of claim 21 further comprising:

temperature sensing and control means for sensing the temperature of said grid means and for varying the power applied to said induction coil means in response thereto.

23. The invention of claim 22 wherein said sensing and control means include thermocouple means disposed in close proximity to said grid means.

24. The invention of claim 8 wherein said thermoplastic is oriented thermoplastic foam sheet.

25. The invention of claim 24 wherein said oriented thermoplastic foam sheet shrinks around said mandrel means to form a container.

26. The method of forming heat shrinkable thermoplastic preforms to a desired shape comprising:

providing a mandrel means of a desired shape;

placing said preform on said mandrel means;

locating said mandrel means and said preform within a grid means; and simultaneously inducing eddy currents in said mandrel means and said grid means to generate heat therein and apply said heat to respective adjacent sides of said preform to cause said preform to shrink on said mandrel means and assume said desired shape.

27. The method of claim 26 wherein the size of said eddy currents is a function of the permeability and configuration of said grid means.

28. The method of claim 27 wherein the size of said eddy currents is a function of the permeability of said mandrel means.

29. The method of claim 28 wherein the permeability of said mandrel means may be varied by coating said mandrel means with a coating having a desired permeability.

30. The method of claim 28 wherein the permeability of said conductive grid means is about 5 times the permeability of said mandrel means.

31. The method of claim 26 wherein said step of inducing eddy currents is performed by driving an induction coil with alternating current adjacent to said grid means and said mandrel means.

32. The method of forming heat shrinkable thermoplastic preforms to a desired shape comprising:

providing a mandrel means of a desired shape;

placing said preform on said mandrel means;

locating said mandrel means and said preform within a grid means; and inducing eddy currents in said grid means to generate heat therein to apply said heat to the respective adjacent sides of said preform to cause said preform to shrink on said mandrel means and assume said desired shape.

33. The method of claim 32 further comprising the step of inducing eddy currents in said mandrel means to preheat said mandrel simultaneous to the step of inducing eddy currents in said grid means.

34. Induction heater means comprising:

a generally channel shaped induction coil defining an elongated path bounded on three sides; and grid means substantially conformally shaped with and mounted within said induction coil, said grid means bounding said path on said three sides bounded by said induction coil means for providing radiant heat along said path in response to an alternating current energization of said induction coil means, said grid means including a plurality of U-shaped bars, each arranged in a plane substantially normal to said elongated path, said bars being spaced along said path.

35. The invention of claim 34 wherein said induction coil produces eddy currents within said grid means to thereby produce said radiant heat.

36. The invention of claim 35 wherein the permeability and configuration of said grid means may be varied to vary the heat radiated.

37. The invention of claim 36 further comprising AC drive means for applying power of said induction coil.

38. The invention of claim 37 further comprising:
temperature sensing and control means for sensing the temperature of said grid means and for varying the power applied to said induction coil in response thereto.

39. The invention of claim 38 wherein said sensing and control means include thermocouple means disposed in close proximity to said grid means.

40. The invention of claim 39 wherein said conductive grid means is formed of a metal from the group consisting of iron and steel.

41. The invention of claim 40 wherein said conductive grid means generally conforms to the shape of said induction coil and is spaced therefrom by insulation means.

* * * * *